United States Patent [19]

Davydov et al.

[11] 4,326,400

[45] Apr. 27, 1982

[54] NON-SLIP MULTI-PASS WIRE MILL

[76] Inventors: Vadim A. Davydov, ulitsa Mikhailova, 29, korpus 3, kv. 57; Vladimir I. Khromov, Leninsky prospekt, 26, kv. 34; Igor M. Makeev, Frunzenskaya naberezhnaya, 36, kv. 227; Aizik M. Kogos, ulitsa Fedora Poletaeva, 24, korpus 2, kv. 50, all of Moscow; Leonid I. Rymarenko, prospekt Lenina, 10 "A", kv. 28, Balashikha Moshovskoi oblasti, all of U.S.S.R.

[21] Appl. No.: 127,946

[22] Filed: Mar. 7, 1980

[30] Foreign Application Priority Data

Mar. 7, 1979 [SU] U.S.S.R. ..... 2734370

[51] Int. Cl.[3] ..... B21C 1/10; B21C 1/27

[52] U.S. Cl. ..... 72/280; 72/286; 72/287; 72/44

[58] Field of Search ..... 72/280, 286, 287, 289, 72/342, 44, 39

[56] References Cited

U.S. PATENT DOCUMENTS

| | | | |
|---|---|---|---|
| 2,127,306 | 8/1938 | Nacken | 72/289 |
| 4,255,957 | 3/1981 | Davydov et al. | 72/281 |

FOREIGN PATENT DOCUMENTS

| | | | |
|---|---|---|---|
| 1001227 | 1/1957 | Fed. Rep. of Germany | 72/289 |
| 1145785 | 10/1957 | France | 72/289 |
| 38-18222 | 9/1963 | Japan | 72/289 |

*Primary Examiner*—Daniel C. Crane

*Attorney, Agent, or Firm*—McAulay, Fields, Fisher, Goldstein & Nissen

[57] ABSTRACT

A nonslip multi-pass wire mill with actuation of blocks by adjustable torque converters, having a coolant-lubricant supply system wherein a pressure line of a pumping station communicates with die holders and through the adjustable torque converters with a bath; the pressure line is connected to a low-pressure zone of a working chamber of each torque converter, a high-pressure zone of the working chamber communicates with the bath at approximately a mid-height thereof. The bath is connected at a lower level thereof to a coolant-lubricant tank using a pipe. The torque converter operates with the coolant-lubricant as a working fluid.

3 Claims, 2 Drawing Figures

NON-SLIP MULTI-PASS WIRE MILL

BACKGROUND OF THE INVENTION

1. Field of the Invention

The invention relates to equipment for manufacturing wire products, and more particularly to nonslip multi-pass wire mills.

The invention can be used for drawing wire from any metal preferably of a diameter smaller than 4 mm.

2. Description of the Prior Art

There are known many types of wet wire mills with both coaxial blocks—either stepped or of equal diameter—and blocks arranged in series. These mills operate with slippage of wire on the blocks and are equipped with systems for supplying process lubricants which are emulsions of various compositions.

For example, low-carbon steel wire is drawn, as a rule, using a water emulsion of a mineral oil and of a soap. This emulsion tends to thicken and segregate, and before drawing can be started, the emulsion is to be heated to an optimum temperature of the process, i.e. to a temperature between 40° and 60° C., and thoroughly stirred.

This explains why wire-drawing fluid supply systems are provided with various types of heaters, such as electric heaters or coiled pipes with circulating heating agents which are usually steam or hot water, built into wire-drawing fluid tanks.

Prior-art multi-pass wire mills also include series-arranged blocks with group actuation from an electric motor through gearings. A liquid process lubricant is supplied to a protective casing-bath and to die holders from a separate pumping station to lubricate blocks and dies. Lubricant storage vesses are three roll-out tanks fitted with electric heaters and cooling devices. Gearing and bearings are lubricated by respective circulating liquid lubricants from another pumping station. All the blocks are provided with internal water cooling.

In these mills, a process lubricant is heated by electric heaters and stirred to a homogeneous condition by circulating it by the pumping station through a closed circuit: tank—pumping station—bath—tank (see, for example, Novye skorostnye stany dlya volocheniya aluminievoi katanki (New high-speed mills for drawing aluminium rod), E.L. Shkol'nikov et al, Elektrotekhnicheskaya promyshlennost', ser. kabel'naya tekhnika, 1976, vyp. 11 (141), Moscow, INFORMELEKTRO, pp. 10–12.

Special-purpose electric heaters for the lubricating fluid complicate the design of the mill, whereas a plan circulation of the lubricating fluid through the system fails to emulsify adequately and homogeneously the lubricating-and-cooling fluid.

Another known wet wire mill is one having a system for supplying an emulsified lubricant, the system comprising a pump which draws the emulsion from an oil sump of the wire mill and delivers it to a service tank. A circulating pump sucks the emulsion from the service tank and forces it through a heater and a cooler to supply it to die holders with dies and to blocks. The system also incorporates temperature regulators, a plurality of valves, filters, pressure gauges and thermometers.

Prior to drawing, the heater and the pumps are energized to circulate the lubricant and to heat it to the optimum drawing temperature (35° to 40° C.). Once this temperature is attained, the mill is started, whereas the heater is de-energized and a cooler is started to extract heat transmitted to the lubricant by a workpiece being deformed (see, for example, Wolfgang Teller, Duisburg, and Günther Schönauer, Kierspe, FRG, Plant for the cooling of lubricants during the drawing of aluminium wire, Wire World International, Düsseldorf, FRG, 1972, v. 14, III/IV, no. 3, pp. 65–66).

However, the quality of the lubricating fluid in this mill is poor, and mill design is complicated by additional units such as heaters.

The closest in design to the present invention is a nonslip multi-pass wire mill consisting of two bed-mounted units with coaxial blocks actuated by adjustable multi-turbine torque converters driven by two electric motors. The torque converters comprise rotors which circulate the fluid through the chambers thereof to transmit motion to the blocks through turbine wheels, and power-operated valves which can cut off emulsion flow and adjust the power input to the blocks.

Die holders with dies are placed in a bath set on a mill bed. The bath also accommodates the blocks which take up wire from respective dies (see, for example, Application No. 54-121264, Cl. B 21C 1/08, filed in Japan in 1979).

In this mill, wire is drawn according to a standard procedure, the process lubricant being soap powder poured by hand into soap-boxes of the die holders.

The main problem in attaining high drawing speeds in this mill is the intensive heating of wire, poor extraction of heat and rapid wear of the dies because the hot wire burns out the lubricant and so impairs lubrication.

SUMMARY OF THE INVENTION

It is therefore an object of the invention to provide a wet-drawing nonslip multi-passe wire mill with substantially improved means for removing deformation-induced heat from wire, blocks and drawing tools, but free from undue complication of the design thereof.

Another object of the invention is to provide a mill which would incorporate a means for supplying quality coolant-lubricant and so ensure efficient wet wire drawing without complicating excessively mill design.

The above and other objects are attained in a nonslip multi-pass wire mill comprising die holders with dies, arranged in a bed-mounted bath which also accommodates blocks actuated by adjustable torque converters from electric motors and wherein, according to the invention, use is made of a system for supplying a coolant-lubricant also serving as a working fluid of the torque converters energizing blocks, the above system incorporating a bath, a pressure line of the system being connected through adjustable throttles to die holders and through adjustable torque converters to the bath, a high-pressure zone of the working chamber communicating with the bath at a mid-height thereof, whereas the bath is connected at its lower level to a coolant-lubricant tank through a draining pipe.

This constructional arrangement of the nonslip multi-pass wire mill improves the drawing process by providing greater drawing speed and, in consequence, higher mill efficiency.

In addition, the above coolant-lubricant supply system includes no heaters which complicate the mill and can readily be mounted on any known mill with the torque converters.

The system for supplying the coolant-lubricant, according to the invention, is a means to heat and stir the coolant-lubricant in a single unit, or adjustable torque converters, by operating them, with throttles closed, using mill main drive electric motors.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
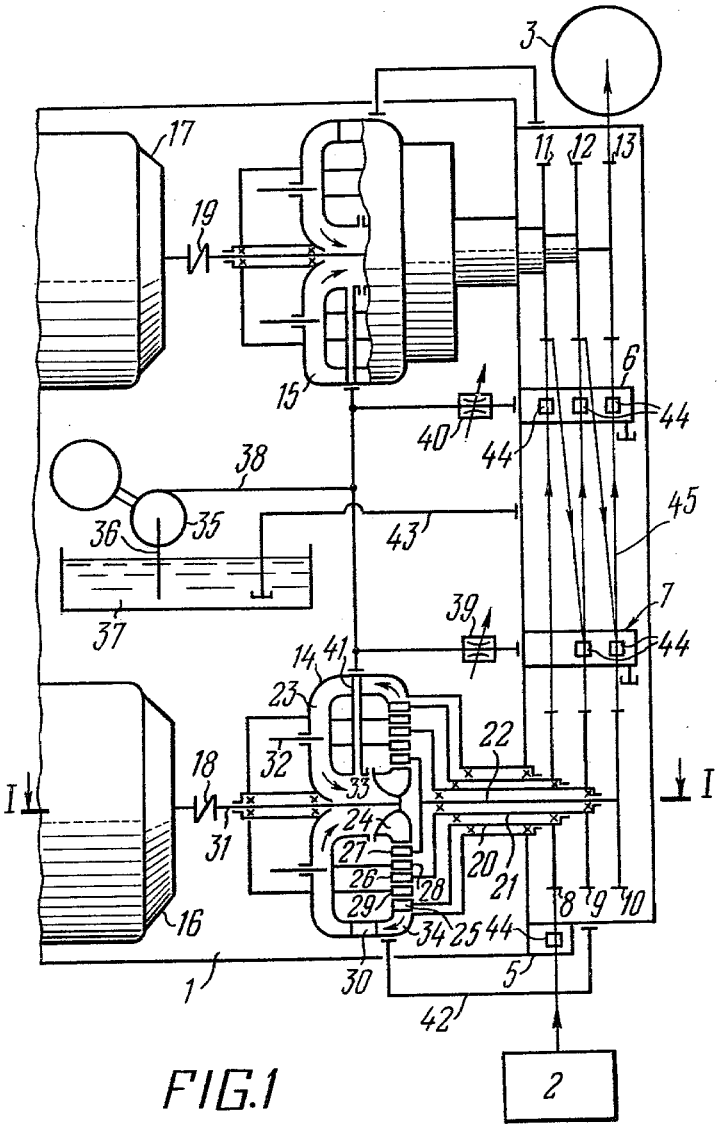
FIG. 1 is a plan view of a nonslip multi-pass wire mill, according to the invention.

A nonslip multi-pass wire mill comprises a bed 1 (FIG. 1) mounted on a foundation, an uncoiler 2 and a coiler 3 placed respectively upstream and downstream of the bed 1 relative to the flow of the process. The bed 1 mounts a bath 4 which accommodates duie holders 5, 6 and 7 and blocks 8, 9, 10, 11, 12 and 13. The blocks are grouped in two units each of three blocks, with the blocks 8, 9, 10 being in the first unit, and the blocks 11, 12, 13, in the second unit, and are actuated by adjustable multi-turbine torque converters 14 and 15 mounted on the bed 1 and driven by electric motors 16 and 17 through couplings 18 and 19.

Each block 8 through 10 and 11 through 13 of each unit is carried by a respective output shaft of the respective multi-turbine torque converter. Thus, the block 8 is set on the output shaft 20; the block 9, on the shaft 21; and the block 10, on the shaft 22.

To simplify the description, we shall consider below the torque converter 14 only, but it should be remembered that the torque converter 15 is identical to the former in all respects.

A working chamber 23 of the multi-turbine torque converter 14 accommodates a pump rotor 24, turbine wheels 25, 26, 27 and stators 28, 29, 30; however, the number of the stators 28 through 30 can be any one desired and so differ from that used in the present preferred embodiment.

The pump rotor 24 is set on an input shaft 31 of the multi-turbine torque converter 14. The turbine wheel 25 is fixed on the output shaft 20, and the turbine wheels 26 and 27, respectively on the output shafts 21 and 22. The stators 28, 29, 30 are placed inside a housing of the multi-turbine torque converter 14.

Each multi-turbine torque converter is fitted with an adjustable annular throttle 32, situated in the working chamber 23 thereof, which controls the flow of the fluid in the working chamber 23 and thus adjusts the power output of the torque converter 14 (or 15) to the blocks 8 through 13. A low-pressure zone 33 develops in the working chamber 23 uptream of the pump rotor 24, a high-pressure zone 34 downstream of the turbine wheel 25 then appearing during the operation of the torque converter 14.

In order to effect the drawing of wire by the mill of the invention in the presence of a coolant-lubricant, the mill incorporates a system for supplying such a coolant-lubricant to the die holders 6 and 7 and to the bath 4, but to simplify the constructional arrangement of the mill, the coolant-lubricant also doubles as a working fluid for the torque converter 14, so that the system is designed differently from the known ones used in slip-drawing wet wire mills.

Such a coolant-lubricant may be any of the emulsions widely used for these purposes in the prior art mills.

The system for supplying a coolant-lubricant contains a pumping station with a pump 35 having its suction pipe 36 immersed into a tank 37, whereas a pressure line 38 communicates with the die holders 6 and 7 through adjustable throttles 39 and 40.

Figure 2:
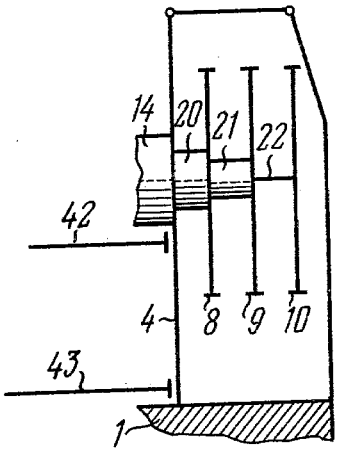
FIG. 2 is a partial section I—I on FIG. 1 through blocks.

The housing of each torque converter 14 and 15 has a duct 41 which communicates the low-pressure zone 33 of the working chamber 23 with the pressure line 38 of the pump 35, whereas the high-pressure zone 34 is connected to the bath 4 at a mid-height thereof (FIG. 2) by a pipe 42. In addition, the bath 4 is connected to the coolant-lubricant tank 37 by a pipe 43 coupled with the bath 4 in the lower level thereof.

The above-described system for supplying the coolant-lubricant indicates that the coolant-lubricant can readily be prepared for the drawing process using the torque converters.

With this arrangement of the coolant-lubricant system, where the coolant-lubricant also serves as the working fluid of the torque converters, the torque converters can be used to condition the fluid for the drawing process, i.e. to intensively heat and stir it.

The above blocks can also be actuated differently; for example, each block can be actuated from a separate torque converter, but a torque converter is essential.

A nonslip multi-pass wire mill operates in the manner below.

The energizing of the electric motors 16 and 17 sets in motion the torque converters 14 and 15.

Once the electric motor 16 is started, it rotates the driving shaft 31 with the pump rotor 24 of the torque converter 14. The working chamber 23 of the torque converter 14 is cut off by the throttle 32, and the drive of the pump 35 is energized, the coolant-lubricant being then taken up by the suction pipe 36 from the tank 37 and delivered through the line 38 and the duct 41 into the low-pressure zone 33 of the working chamber 23 of the torque converter 14. At the same time, the coolant-lubricant is supplied to the die holders 6 and 7 with the dies 44 through the throttles 39 and 40 which are adjusted for a small delivery rate. The coolant-lubricant is discharged from the torque converter 14 through the pipe 42 into the bath 4, and therefrom, into the tank 37 through the pipe 43 connected to the bath 4 in the lower level thereof.

The operation of the torque converter with the closed throttle corresponds to the zero efficiency thereof, as the torque converter performs no useful mechanical work. However, under these conditions it fails to consume the whole of the power which the electric motor 16 develops. Depending on design, a torque converter 14 can consume, with the throttle closed, up to 50% of the electric motor power output, this power being utilized for intensively heating and stirring the coolant-lubricant.

After multiple circulation of the coolant-lubricant through the circuit "tank 37—pump 35—torque converter 14—bath 4—tank 37", it is heated to the temperature specified for the drawing process and undergoes intensive stirring, so that the mill can be prepared further for starting by threading a wire 45 therethrough.

The mill is accelerated to drawing speed by gradually opening the throttles 32, this starting the circulation of the coolant-lubricant in the working chamber 23 from the pump rotor 24 successively through the turbine wheels 27, 26 and 25, imparting to them and through them to the blocks 8, 9 and 10 coupled therewith, the necessary rotation. The power transmitted from the pump rotor 24 to the turbine wheels 25, 26 and 27 is proportional to the opening of the throttle 32.

During the drawing of the wire 45, the pump 35 continues to run the coolant-lubricant through the circuit "tank 37—pump 35—torque converter 14—bath 4—tank 37", the coolant-lubricant being continuously stirred and supplied to the die holders 6, 7 and to the bath 4 by widely known techniques.

The characteristics of each turbine wheel 25 through 27 are such as to enable it to draw the wire 45 through the respective die 44 and to tension the wire adequately.

As the torque converter 14 is inherently automatic (the speed changes automatically with the load), even negligible variations in the load upon the blocks 8 through 13 lead to a corresponding re-distribution of speeds among the blocks 8 through 13, without affecting the drawing process.

Provision of the torque converters 14, 15 in the coolant-lubricant system substantially improves the quality of the coolant-lubricant by maximizing the fineness and the homogeneity thereof and also intensifies the heating of the coolant-lubricant to the temperature specified for drawing.

Introducing the coolant-lubricant supplying system into the mill would permit the latter to be adapted to wet drawing of wire without slip on the blocks.

The constructional arrangement according to the invention ensures a most effective utilization of the mill equipment and enhances the functional potentialities of torque converters, other advantages including greater machine time of the mill, better drawing procedures, simpler operation and servicing of the mill.

What is claimed is:

1. A nonslip multi-pass wire mill comprising:

a bed;

a coiler;

an uncoiler;

a bath mounted on said bed;

a plurality of dies for wire drawing;

die holders for said dies, arranged inside said bath in an order ensuring the manufacture of a wire of specified dimensions;

a plurality of blocks sequentially located relative to said dies to effect drawing;

at least one adjustable torque converter actuated by an electric motor; said torque converter rotating at least one of said individual blocks; said torque converter comprising:

a housing having a working chamber containing a working fluid necessary for the operation of said torque converter;

a pump rotor mounted in said working chamber for producing during pumping a low-pressure zone and a high-pressure zone upstream and downstream, respectively, of said rotor;

turbines, the number of which corresponds to that of said blocks; said turbines being actuated by said torque converter, said turbines being mounted in said working chamber of said housing of said torque converter and cooperating with the pump rotor; said mill further including:

a system for supplying a coolant-lubricant serving also as said working fluid of said torque converters comprising:

a coolant-lubricant tank;

a pumping station communicating with said tank and having a pressure line;

adjustable throttles, the number of which corresponds to that of said die holders;

said pressure line connected through said adjustable throttles to said die holders for supplying thereto said coolant-lubricant during the drawing of wire;

ducts in said housing of each said torque converter connecting said pressure line with said low-pressure zone of each said torque converter;

pipes connecting said high-pressure zone of each said torque converter and said bath;

a draining pipe connecting said bath in a lower level thereof to said tank;

the connection between said ducts, said pipes and said working chambers of each said torque converter providing communication between said pressure line and said bath causing circulation of said coolant-lubricant through said torque converter thereby conditioning said coolant-lubricant for drawing wire by said torque converter.

2. The mill of claim 1, wherein each block is actuated by a separate torque converter.

3. The mill of claim 1 or 2, wherein said pipes connect said high pressure zone of each torque converter with said bath approximately at mid-height thereof.

* * * * *